US008434239B2

(12) United States Patent
Zoucha

(10) Patent No.: US 8,434,239 B2
(45) Date of Patent: May 7, 2013

(54) METHOD AND MEANS FOR DRYING GRAIN IN A STORAGE BIN

(76) Inventor: James Zoucha, Orchard, NE (US)

( * ) Notice: Subject to any disclaimer, the term of this patent is extended or adjusted under 35 U.S.C. 154(b) by 469 days.

(21) Appl. No.: 12/660,957

(22) Filed: Mar. 8, 2010

(65) Prior Publication Data

US 2011/0167667 A1 Jul. 14, 2011

Related U.S. Application Data

(63) Continuation-in-part of application No. 12/657,126, filed on Jan. 14, 2010.

(51) Int. Cl.
*F26B 3/34* (2006.01)

(52) U.S. Cl.
USPC ..... 34/266; 34/267; 34/218

(58) Field of Classification Search ..... 34/266, 34/267, 201, 218
See application file for complete search history.

(56) References Cited

U.S. PATENT DOCUMENTS 4,616,695 A * 10/1986 Takahashi et al. ..... 165/54
4,750,273 A 6/1988 Parkes et al.
5,653,552 A * 8/1997 Wiley et al. ..... 404/77
6,834,443 B2 12/2004 Bloemendaal
2007/0079623 A1* 4/2007 Inaba et al. ..... 62/260
2011/0167666 A1* 7/2011 Zoucha ..... 34/267

* cited by examiner

*Primary Examiner* — Jiping Lu
(74) *Attorney, Agent, or Firm* — Dennis L. Thotme; Thomte Patent Law Office LLC

(57) ABSTRACT

An apparatus is disclosed for drying grain in a storage bin as well as the method of drying the grain. The apparatus includes an air blower positioned outwardly of the storage bin which has an air inlet end and an air discharge end. The air discharge end of the air blower is in communication with the interior of the storage bin. A heat exchanger is positioned in a spaced relationship with respect to the air blower and has an air passageway with an inlet end and an outlet end. The outlet end of the heat exchanger is spaced from the inlet end of the air blower. An infrared heater is spaced from the inlet end of the heat exchanger so that infrared rays from the infrared heater will be directed into the air passageway of the heat exchanger so that the heat exchanger will heat the air being drawn through the heat exchanger by the air blower with the air blower sucking heated air from the air passageway and blowing the same into the storage bin to dry the grain therein. The heat exchanger includes an outer shroud which is trapezoidal in plan view. The heat exchanger includes heat exchanger assemblies which are generally trapezoidal in shape.

3 Claims, 7 Drawing Sheets

METHOD AND MEANS FOR DRYING GRAIN IN A STORAGE BIN

CROSS-REFERENCE TO RELATED APPLICATION

This application is a continuation-in-part of application Ser. No. 12/657,126 filed Jan. 14, 2010.

BACKGROUND OF THE INVENTION

1. Field of the Invention

This invention relates to an apparatus for drying grain in a storage bin as well as the method of drying the grain. More particularly, the apparatus of this invention includes an infrared heater which heats components of a heat exchanger spaced from the infrared heater with the heat exchanger being in communication with the inlet end of an air blower. The discharge end of the air blower is in communication with the interior of the storage bin. Even more particularly, the apparatus of this invention heats the air passing through the heat exchanger by the air passing over the heated components of the heat exchanger. The heated air is then blown into the interior of the storage bin by the air blower to dry the grain therein. Even more particularly, the heat exchanger has a shape which permits a plurality of heat exchangers to be positioned in a side-by-side relationship with the heated exhausts thereof converging prior to entering the inlet of the air blower.

2. Description of the Related Art

Many devices have been previously provided for drying grain contained within a storage bin. Normally, the prior art devices include a gas burner for heating air which is blown into the interior of the storage bin by an air blower which may be either an axial blower or a centrifugal blower. The prior art gas burners usually are fueled by propane which is extremely expensive. Although the apparatus of the co-pending application functions extremely well, Applicant has found ways to improve the functionality and efficiency of the apparatus of the co-pending application.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An apparatus is described for drying grain in a storage bin. A conventional air blower is provided which has an air inlet end and an air discharge end with the air discharge end of the air blower being in communication with the interior of the storage bin in conventional fashion. A heat exchanger is also provided which has an air passageway with an inlet end and an outlet end. The heat exchanger, when viewed from above, has a trapezoidal shape with the inlet end of the heat exchanger having a greater width than the outlet end of the heat exchanger. The outlet end of the heat exchanger is spaced from the inlet end of the air blower. The apparatus also includes an infrared heater spaced from the inlet end of the heat exchanger whereby infrared rays from the infrared heater are directed into the air passageway of the heat exchanger to heat internal components within the heat exchanger so that air being drawn through the air passageway by the air blower will be heated as the air passes over the heated internal components of the heat exchanger. The air blower sucks the heated air from the air passageway and heats the heated air into the storage bin to dry the grain therein.

The internal components of the heat exchanger include a plurality of spaced-apart vanes which are preferably coated with a high-temperature dark paint to enhance the absorption of the rays from the heater so that the vanes are heated. In the preferred embodiment, a shroud surrounds the heat exchanger between the inlet and outlet ends thereof which is spaced from the heat exchanger.

The trapezoidal shape of the heat exchanger permits two or more heat exchangers to be closely positioned together in a side-by-side relationship so that the heated air exiting the heat exchangers will at least partially converge prior to entering the intake end of the air blower.

The method of drying the grain is also disclosed.

It is therefore a principal object of the invention to provide an improved apparatus for drying grain in a storage bin.

A further object of the invention is to provide an improved method for drying grain in a storage bin.

A further object of the invention is to provide an apparatus for drying grain in a storage bin with the apparatus including an infrared heater.

A further object of the invention is to provide an apparatus of the type described wherein the infrared heater is fueled by diesel fuel.

A further object of the invention to provide a means for drying grain in a storage bin which is extremely efficient and which is more economical than the methods of the prior art.

Yet another object of the invention is to provide an improved heat exchanger for use in the apparatus of this invention.

Still another object of the invention is to provide a heat exchanger having a trapezoidal shape in plan view.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
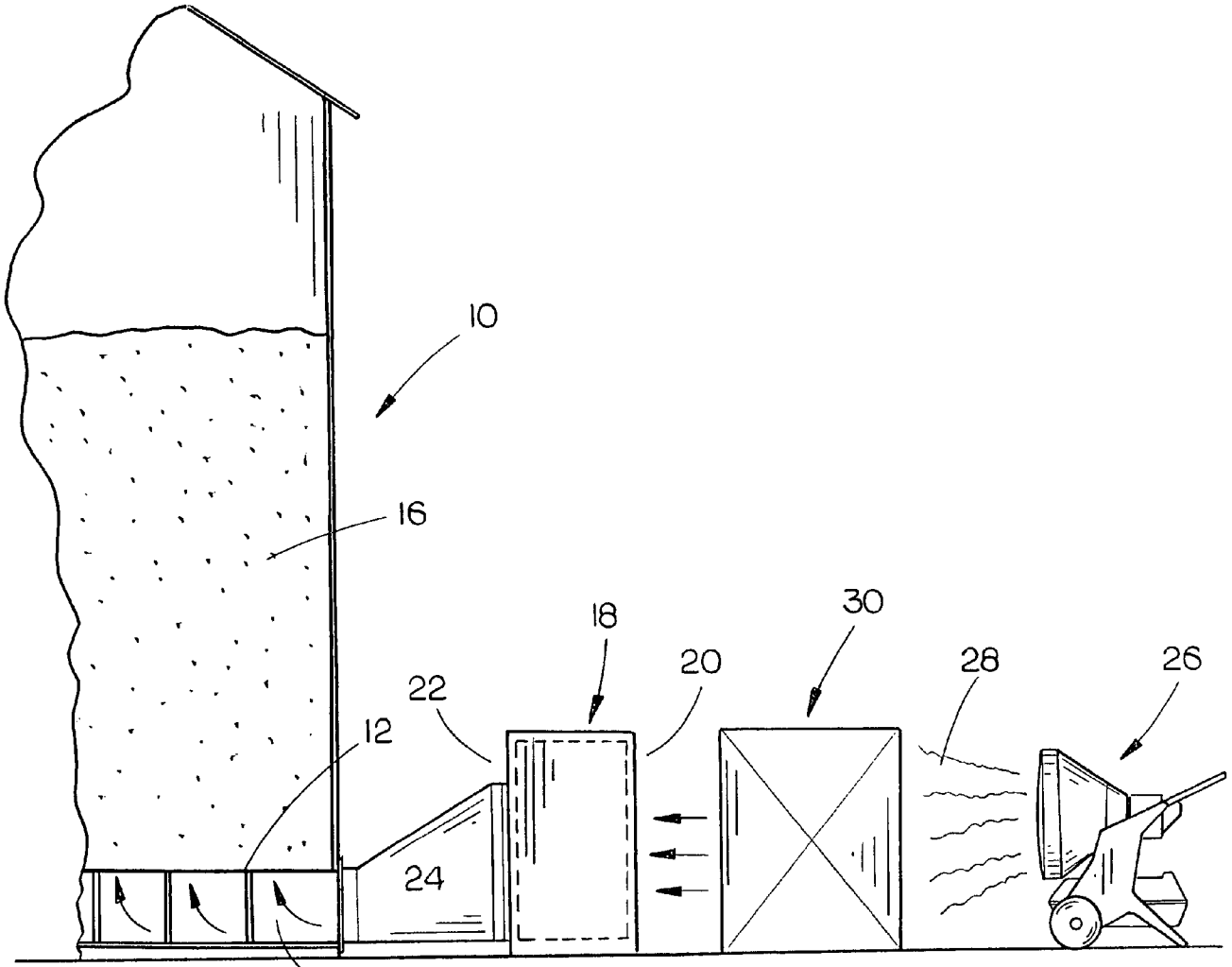
FIG. 1 is a side view illustrating the means of this invention for drying grain in a storage bin.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

In the drawings, the numeral 10 refers to a conventional storage bin which has a perforated floor 12 spaced above the lower end thereof with a plenum 14 being provided beneath the floor 12. Normally, the storage bin 10 will have a pair of air outlets positioned in the roof thereof and will have a conventional selectively closable center opening formed therein at the peak of the roof. The numeral 16 refers to grain contained within the storage bin.

A conventional air blower or fan 18 is provided which has an air inlet end 20 and an air discharge end 22 which is in communication with a transition housing or shroud 24 which extends to the plenum 14 so that when the blower 18 is activated, air will be blown into the plenum 14 and upwardly through the perforated floor 12 into the grain and then pass outwardly from the bin 10 by way of the outlets and central opening in the roof of the bin 10. The blower 18 may be either an axial flow blower or a centrifugal blower.

Figure 3:
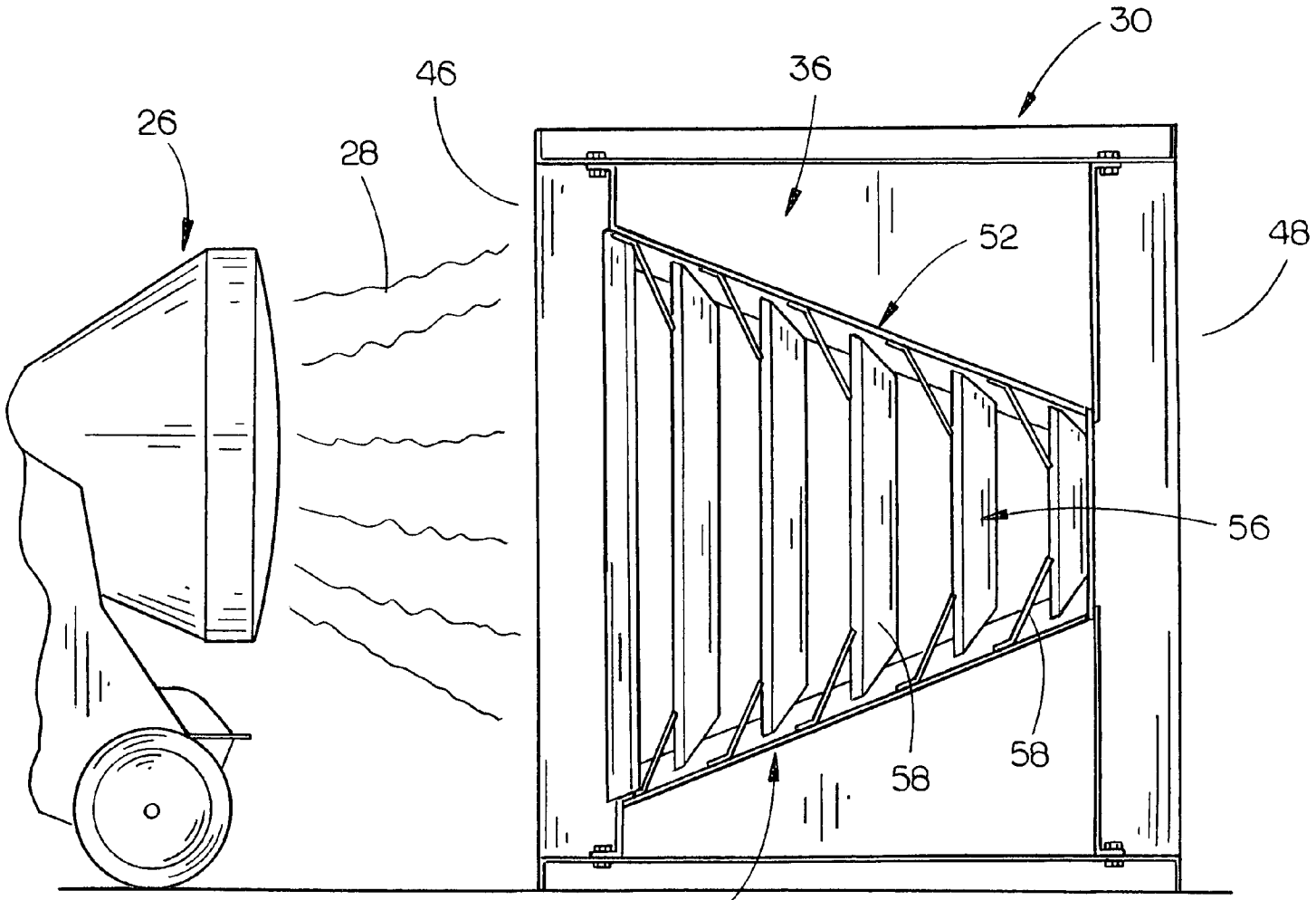
FIG. 3 is a side elevational view of the infrared heater and the heat exchanger with portions thereof cut away to more fully illustrate the invention.
Figure 4:
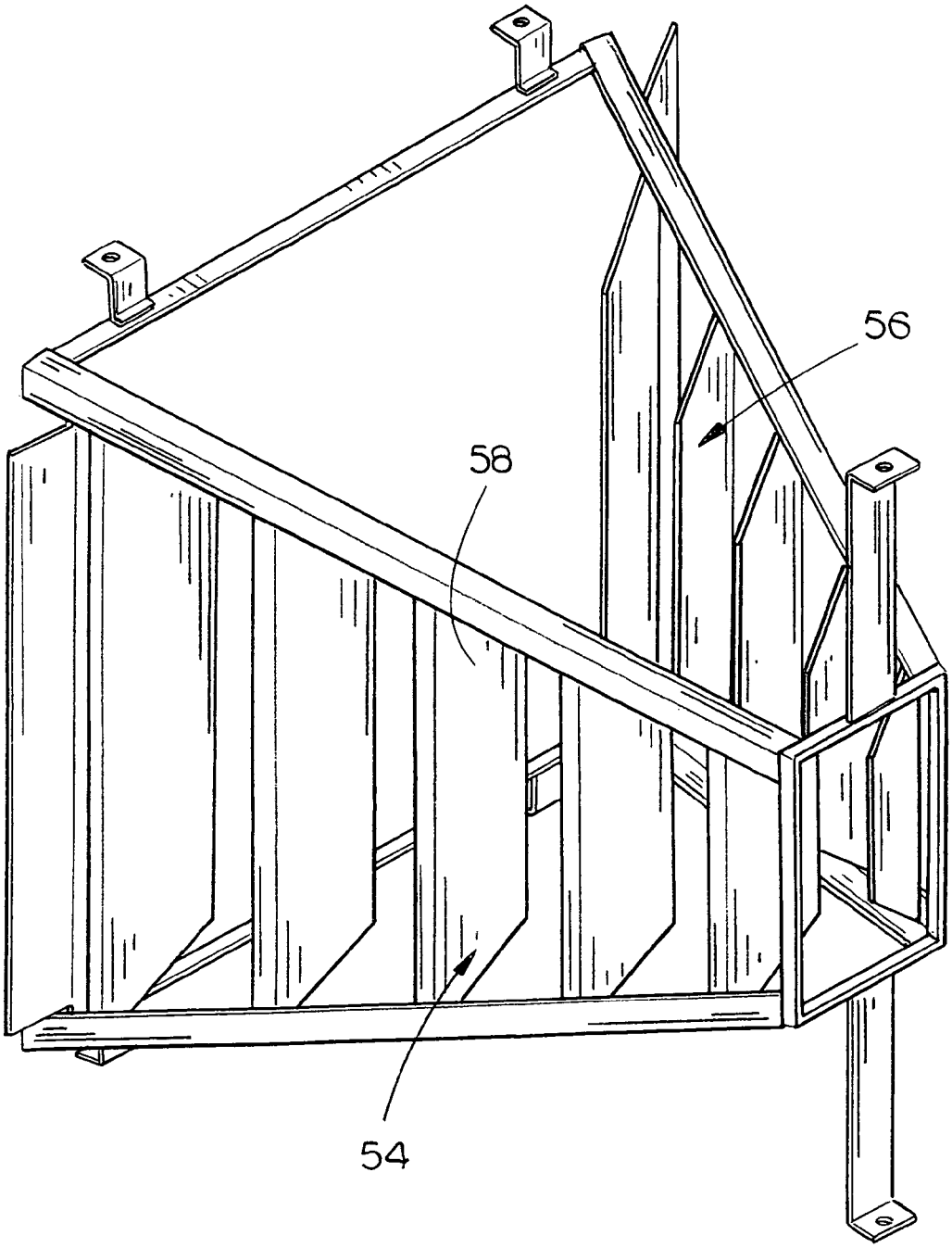
FIG. 4 is a front perspective view of the heat exchanger portion of this invention.
Figure 5:
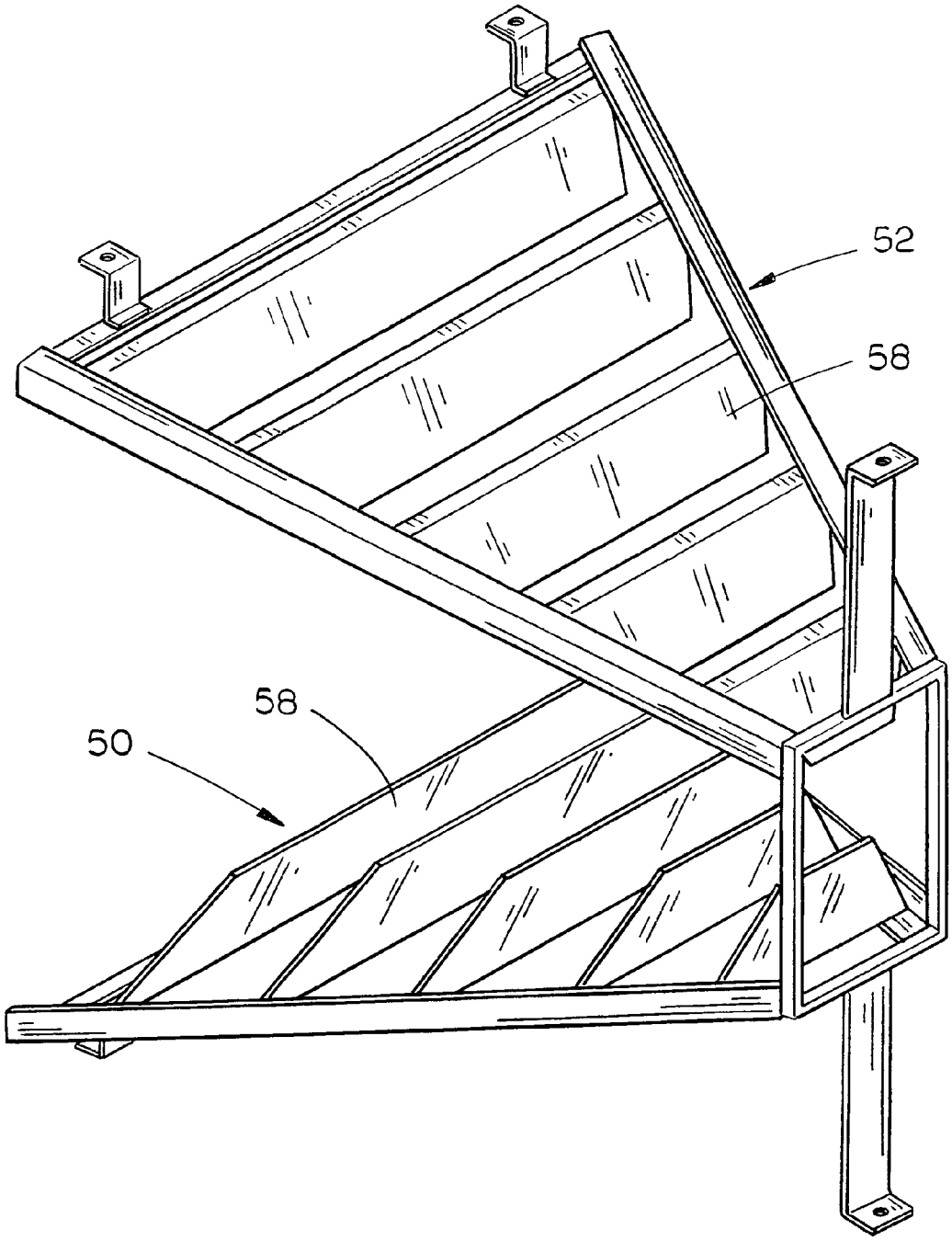
FIG. 5 is perspective view of the upper and lower exchanger assemblies in the heat exchanger.
Figure 6:
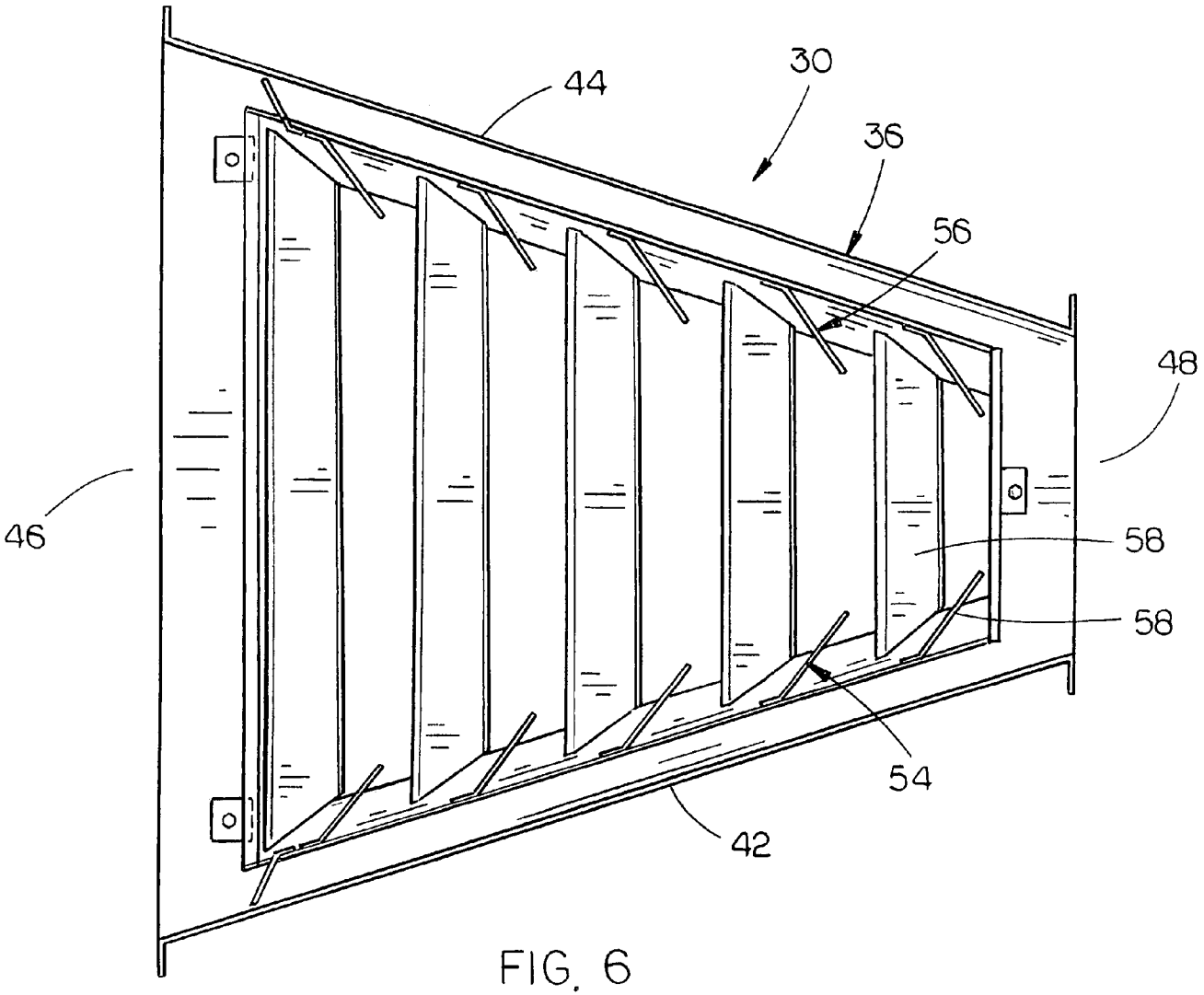
FIG. 6 is a top view of the heat exchanger portion of this invention with a portion thereof cut-away to more fully illustrate the invention.

The numeral 26 refers to an infrared heater such as the Val6 Series heater manufactured and sold by Shizuoka Seiki Co., Ltd., having an address of 4-1 Yamana, Fukuroi-shi, Shizuoka-ken, Japan. The infrared heater 26 is diesel fuel fired and emits infrared rays 28 therefrom as illustrated in FIGS. 1 and 3 in conventional fashion when the heater is energized.

The numeral 30 refers to the heat exchanger of this invention which enables the heater 26 to be used in conjunction with the air blower 28 so as to provide heated air to be furnished to the inlet end of the air blower 18 so that the air blower 18 may blow the heated air into the plenum 14 and into the grain 16 through the perforated floor 12 as will be described in greater detail hereinafter.

Heat exchanger 30 includes an outer shroud or housing 36 which extends around the internal components of the heat exchanger 30 and which includes a top wall 38, a bottom wall 40, and opposite side walls 42 and 44. For purposes of description, shroud 36 will be described as having an air inlet end 46 and an air discharge end 48.

Figure 2:
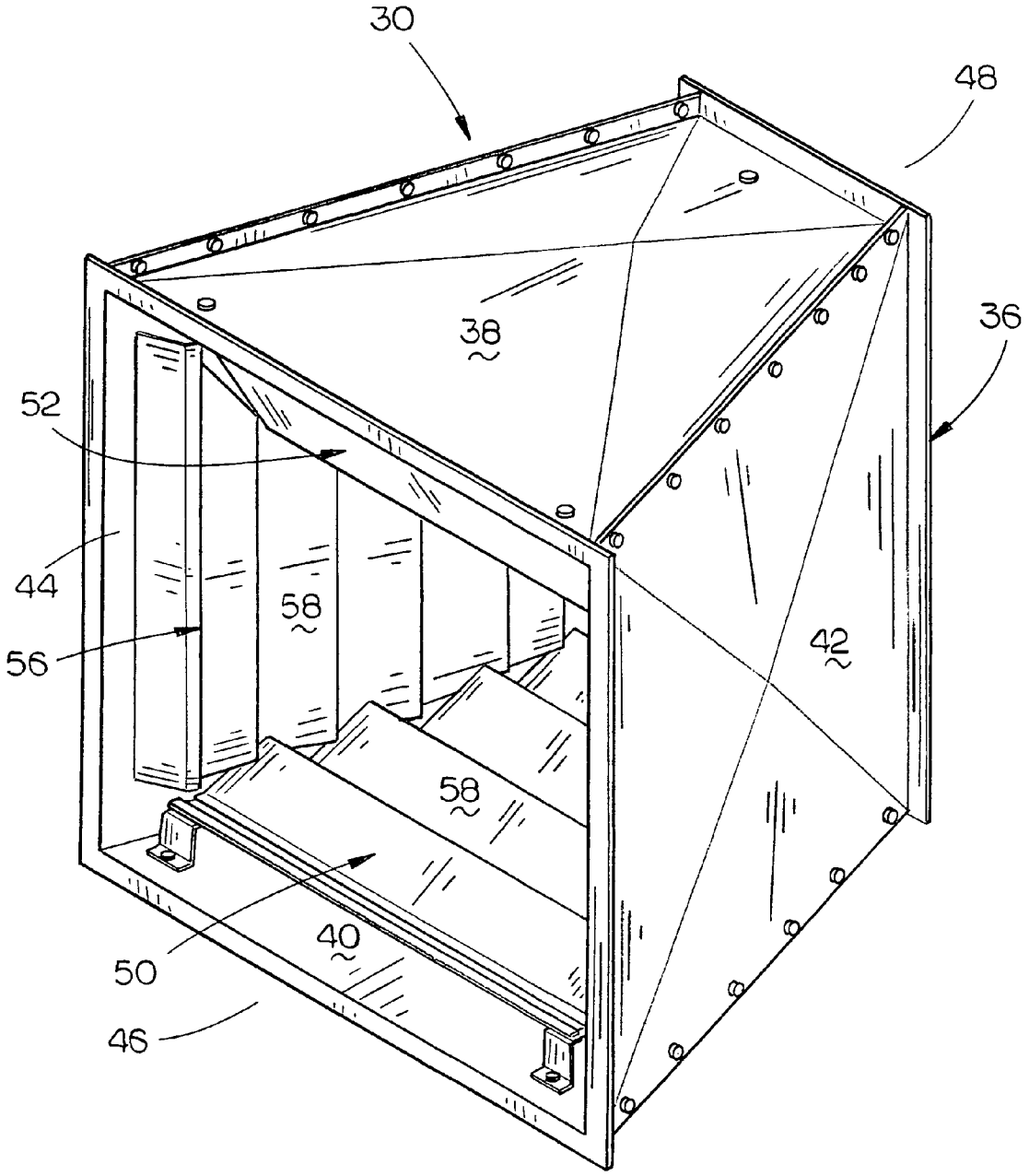
FIG. 2 is a rear perspective view of the heat exchanger portion of this invention.

Shroud 36, when viewed in plan view, is trapezoidal in shape as seen in FIG. 2, with the top wall 38 being trapezoidal-shaped and with the bottom wall 40 being trapezoidal in shape. As seen in FIG. 2, the inlet end 46 of shroud 36 has a greater diameter than the discharge end 48 of shroud 36.

Heat exchanger 30 includes a first heat exchanger assembly 50, a second heat exchanger assembly 52, a third heat exchanger assembly 54 and a fourth heat exchanger assembly 56 which define a generally quadrilateral cross-section with the intake end thereof having a larger opening than the discharge end thereof. Each of the heat exchanger assemblies 50, 52, 54 and 56 include a plurality of spaced-apart, angularly disposed vanes, fins or blades 58. Each of the heat exchanger assemblies 50, 52, 54 and 56 are generally trapezoidal in shape.

The vanes 58 are preferably coated with a high temperature dark colored paint to increase the heat absorption of the vanes. The heat exchanger assemblies 50, 52, 54 and 56 define an air passageway therebetween. The heat exchanger 30 is supported by the shroud 36 by means of a framework 57. The spacing of the shroud 36 from the heat exchanger assemblies creates an insulation space therebetween to prevent heat loss from the heat exchanger assembly.

As seen in the drawings, the discharge side of the heater 28 is spaced from the inlet end of the shroud 36 of heat exchanger 30. The infrared rays 28 from the heater 30 are directed into the inlet end of the shroud 36 with the vanes 58 being radiantly heated by the infrared rays 28 from the infrared heater 30. When blower 32 is actuated, blower 18 draws or sucks air into the inlet end of the shroud 36 onto the vanes 62, 68, 70 and 76 of the heat exchanger assemblies 50, 52, 54 and 56 respectively with the same being radiantly heated. As the air is being sucked through the passageway between the assemblies 50, 52, 54 and 56 by the blower 18, the air is passed over the vanes 58 and is deflected inwardly by the heat exchanger assemblies 54 and 56, is deflected upwardly by the heat exchanger assembly 50, and is deflected downwardly by the heat exchanger assembly 52. As the air passes over the vanes 58, the air is heated by those heated vanes and is sucked from the discharge end of the heat exchanger 30 into the blower 18 and then into the interior of the storage bin and into the grain to dry the same.

The use of a diesel fired infrared heater 26 greatly decreases the cost of drying the grain since the infrared heater 26 is highly efficient and is able to burn diesel fuel which is less expensive than propane and which is more efficient.

Figure 7:
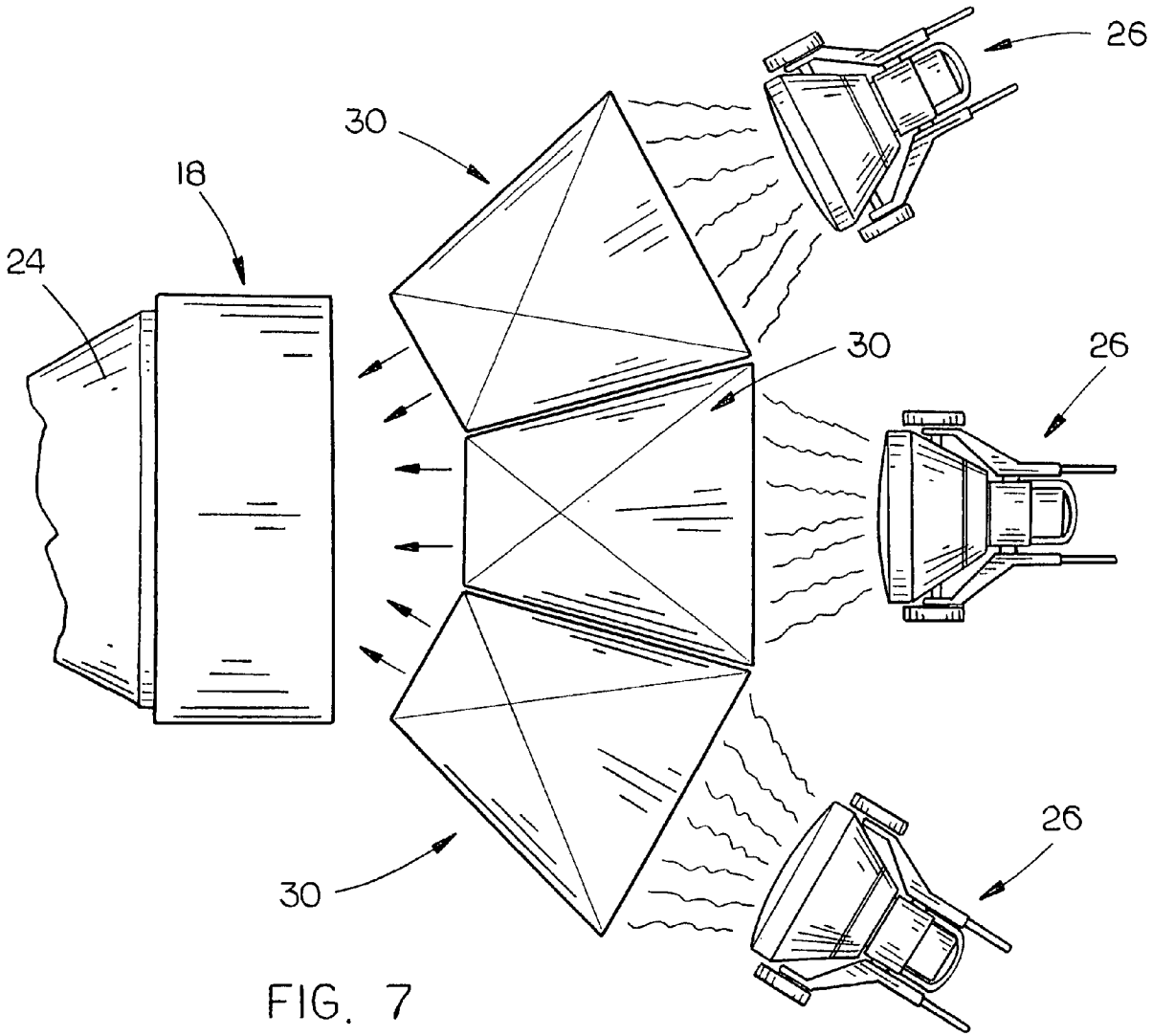
FIG. 7 is a top elevational view of the apparatus of this invention which illustrates three heat exchangers being positioned closely together in a side-by-side relationship.

The trapezoidal shape of the shroud 36 enables a plurality of the heat exchangers 30 to be positioned closely adjacent one another in a side-by-side relationship as seen in FIG. 7 so that the heated air passing from the heat exchanger 30 will converge somewhat so as to be drawn into the intake end of air blower 18.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. An apparatus for drying grain in a storage bin, comprising:

an air blower having an air inlet end and an air discharge end;

said air discharge end of said air blower being in communication with the interior of the storage bin;

a shroud having an upper wall, a lower wall, a first side wall, a second side wall, an open inlet end and an open outlet end;

said upper wall of said shroud having a trapezoidal shape;

said lower wall of said shroud having a trapezoidal shape;

said upper wall of said shroud including an inlet end, an outlet end, a first side and a second side;

said lower wall of said shroud including an inlet end, an outlet end, a first side and a second side;

said first side wall of said shroud including en inlet end, an outlet end, an upper end and a lower end;

said second side wall of said shroud including an inlet end, an outlet end, an upper end and a lower end;

said first side of said upper wall of said shroud being connected to said upper end of said first side wall of said shroud;

said second side of said upper wall of said shroud being connected to said upper end of said second side wall of said shroud;

said first side of said lower wall of said shroud being connected to said lower end of said first side wall of said shroud;

said second side of said lower wall of said shroud being connected to said lower end of said second side wall of said shroud;

said inlet ends of said upper and lower walls of said shroud having a greater width than said outlet ends of said upper and lower walls whereby said upper and lower walls of said shroud define a trapezoidal shape with the inlet end of said shroud having a greater width than the outlet end thereof;

first, second, third and fourth heat exchanger assemblies positioned in said shroud;

an upper heat exchanger assembly positioned in said shroud below said upper wall of said shroud;

said upper heat exchanger having a first end, a second end, a first side and a second side;

said upper heat exchanger having a trapezoidal shape;

a lower heat exchanger assembly positioned in said shroud above said lower wall of said shroud;

said lower heat exchanger assembly having a first end, a second end, a first side and a second side;

said lower heat exchanger assembly having a trapezoidal shape;

a first side heat exchanger assembly positioned in said shroud inwardly of said first side wall of said shroud;

said first side heat exchanger assembly having a first end, a second end, an upper end and a lower end;

a second side heat exchanger assembly positioned in said shroud inwardly of said second wall of said shroud;

said second side heat exchanger assembly having a first end, a second end, an upper end and a lower end;

said upper heat exchanger assembly, said lower heat exchanger assembly, said first side heat exchanger assembly and said second side heat exchanger assembly defining a heat exchanger having an air passageway extending therethrough with an inlet end and an outlet end;

said outlet end of said heat exchanger being spaced from said inlet end of said air blower;

and an infrared heater spaced from said inlet end of said heat exchanger whereby infrared rays from said infrared heater will be directed into said air passageway of said heat exchanger so that said heat exchanger assemblies will be heated by said infrared rays to heat the air being drawn through said heat exchanger by said air blower;

said air blower sucking heated air from said air passageway and blowing the same into the said storage bin to dry the grain therein;

each of said heat exchanger assemblies having a plurality of spaced-apart vanes provided thereon which are heated by the infrared rays passing into said heat exchanger.

2. The apparatus of claim 1 wherein said vanes are angularly disposed so as to deflect the air passing through said air passageway.

3. The apparatus of claim 1 wherein said vanes are coated with a dark colored paint to enhance the heat absorption of said vanes.

* * * * *